US010907912B2

(12) United States Patent
Monacchio et al.

(10) Patent No.: US 10,907,912 B2
(45) Date of Patent: Feb. 2, 2021

(54) OUTLET MANIFOLD

(71) Applicant: Hamilton Sundstrand Corporation, Charlotte, NC (US)

(72) Inventors: John D. Monacchio, Windsor Locks, CT (US); Eric Chrabascz, Longmeadow, MA (US); Luke J. Mayo, Coventry, CT (US); John H. Whiton, South Windsor, CT (US); Robert H. Dold, Monson, MA (US); Christopher Adriaan van Oss, Wethersfield, CT (US); Usman Khan, South Windsor, CT (US)

(73) Assignee: HAMILTON SUNSTRAND CORPORATION, Charlotte, NC (US)

( * ) Notice: Subject to any disclaimer, the term of this patent is extended or adjusted under 35 U.S.C. 154(b) by 0 days.

(21) Appl. No.: 16/130,698

(22) Filed: Sep. 13, 2018

(65) Prior Publication Data

US 2020/0088478 A1 Mar. 19, 2020

(51) Int. Cl.

| | |
|---|---|
| ***F28F 9/02*** | (2006.01) |
| ***F01N 13/10*** | (2010.01) |
| ***F01N 13/06*** | (2010.01) |

(52) U.S. Cl.

CPC ..... *F28F 9/0275* (2013.01); *F01N 13/06* (2013.01); *F01N 13/10* (2013.01); *F01N 13/107* (2013.01)

(58) Field of Classification Search

CPC combination set(s) only.
See application file for complete search history.

(56) References Cited

U.S. PATENT DOCUMENTS

| | | | | |
|---|---|---|---|---|
| 2,727,355 | A * | 12/1955 | Wosika | F02B 27/04 60/313 |
| 5,956,949 | A * | 9/1999 | Mayer | F01N 3/05 60/284 |
| 6,435,272 | B1 * | 8/2002 | Voss | F01N 3/02 15/4 |
| 7,770,690 | B2 * | 8/2010 | Schorn | F01N 3/2885 180/296 |
| 8,713,923 | B2 * | 5/2014 | Morita | F01N 3/10 60/313 |

(Continued)

FOREIGN PATENT DOCUMENTS

| | | |
|---|---|---|
| EP | 3193127 A1 | 7/2017 |
| FR | 871866 A | 5/1942 |

(Continued)

OTHER PUBLICATIONS

European Search Report Application No. 19185337.3; dated Jun. 15, 2020; pp. 7.

*Primary Examiner* — Binh Q Tran
(74) *Attorney, Agent, or Firm* — Cantor Colburn LLP

(57) ABSTRACT

An outlet manifold is provided and includes an outlet portion having first and second sides and an inlet portion to which the outlet portion is fluidly coupled. The inlet portion has first and second sides corresponding to the first and second sides of the outlet portion. Each of the first and second sides of the inlet portion includes one or more tubular members connectable with corresponding tube joints and a mixing chamber fluidly interposed between each of the one or more tubular members and the outlet portion.

9 Claims, 3 Drawing Sheets

(56) References Cited

U.S. PATENT DOCUMENTS

| | | | | |
|---|---|---|---|---|
| 9,021,804 | B2 * | 5/2015 | Zhang | F02M 26/06 60/605.2 |
| 9,200,855 | B2 | 12/2015 | Kington et al. | |
| 9,328,968 | B2 | 5/2016 | Vanderwees | |
| 10,596,898 | B2 * | 3/2020 | Herwat | F01N 1/023 |
| 2017/0328640 | A1 | 11/2017 | Schwalm | |

FOREIGN PATENT DOCUMENTS

| | | | |
|---|---|---|---|
| WO | 2005113955 | A1 | 12/2005 |
| WO | 2010131272 | A1 | 11/2010 |

* cited by examiner

OUTLET MANIFOLD

STATEMENT OF FEDERAL SUPPORT

This invention was made with government support under D6305-ATPC-28-F1-410X420 awarded by the United States Air Force. The government has certain rights to the invention.

BACKGROUND

The following description relates to heat exchangers and, more specifically, to an outlet manifold of a heat exchanger.

Heat exchangers are typically devices that bring two physical elements, such as hot and cold fluids, into thermal communication with each other. In a heat exchanger in a duct, the hot and cold fluids can be air where the cold air is flown through tubes extending throughout the heat exchanger and the hot air is directed toward fins of the heat exchanger which are thermally communicative with the tubes. In this way, heat is removed from the hot air and transferred to the material of the fins, from the fins to the tubes and from the tubes to the cold air. The temperature of the cold air is thus increased as the cold air proceeds through the heat exchanger.

BRIEF DESCRIPTION

According to an aspect of the disclosure, an outlet manifold is provided and includes an outlet portion having first and second sides and an inlet portion to which the outlet portion is fluidly coupled. The inlet portion has first and second sides corresponding to the first and second sides of the outlet portion. Each of the first and second sides of the inlet portion includes one or more tubular members connectable with corresponding tube joints and a mixing chamber fluidly interposed between each of the one or more tubular members and the outlet portion.

In accordance with additional or alternative embodiments, the outlet portion has an annular shape defining the first and second sides.

In accordance with additional or alternative embodiments, the mixing chambers are adjacent to the outlet portion and the one or more tubular members of each of the first and second sides of the inlet portion extend laterally outwardly from the respective mixing chambers.

In accordance with additional or alternative embodiments, each tubular member includes a tubular member end, a bushing, which is fittable onto the tubular member end and a tube seal, which is fittable in an interior of the bushing.

In accordance with additional or alternative embodiments, for each tubular member for which the tubular member end is offset from a center of the mixing chamber, the tubular member includes a curved section.

In accordance with additional or alternative embodiments, the mixing chambers of the first and second sides of the inlet portion include curved surfaces leading to the outlet portion.

In accordance with additional or alternative embodiments, the mixing chambers of the first and second sides of the inlet portion are fluidly communicative through a common orifice.

In accordance with additional or alternative embodiments, the one or more tubular members of each of the first and second sides of the inlet portion are symmetric about an axis bifurcating the respective first and second sides of the outlet and inlet portions.

According to another aspect of the disclosure, a heat exchanger assembly is provided and includes a backplane, an inlet manifold configured to direct fluid from a first backplane side to a second backplane side, first heat exchangers supported on the second backplane side and configured to direct the fluid in opposite outward directions, second heat exchangers and an outlet manifold. The second heat exchangers are supported on the first backplane side, include one or more tube joints and are configured to direct the fluid in opposite inward directions toward the tube joints. The outlet manifold includes, at opposite sides thereof, one or more tubular members configured to respectively connect with corresponding ones of each of the one or more tube joints of each of the second heat exchangers.

In accordance with additional or alternative embodiments, the backplane is curved and the opposite outward and inward directions are oriented circumferentially.

In accordance with additional or alternative embodiments, the outlet manifold is coupled to an engine duct.

In accordance with additional or alternative embodiments, the outlet manifold includes an outlet portion having first and second circumferential sides and an inlet portion to which the outlet portion is fluidly coupled. The inlet portion has first and second circumferential sides corresponding to the first and second circumferential sides of the outlet portion and each of the first and second circumferential sides of the inlet portion includes the one or more tubular members and a mixing chamber fluidly interposed between each of the one or more tubular members and the outlet portion.

In accordance with additional or alternative embodiments, the outlet portion has an annular shape defining the first and second circumferential sides.

In accordance with additional or alternative embodiments, the mixing chambers are adjacent to the outlet portion and the one or more tubular members extend laterally outwardly from the respective mixing chambers.

In accordance with additional or alternative embodiments, each tubular member includes a tubular member end, a bushing, which is fittable onto the tubular member end and a tube seal, which is fittable in an interior of the bushing.

In accordance with additional or alternative embodiments, for each tubular member for which the tubular member end is offset from a center of the mixing chamber, the tubular member includes a curved section.

In accordance with additional or alternative embodiments, the mixing chambers of the first and second circumferential sides of the inlet portion include curved surfaces leading to the outlet portion.

In accordance with additional or alternative embodiments, the mixing chambers of the first and second circumferential sides of the inlet portion are fluidly communicative through a common orifice.

In accordance with additional or alternative embodiments, the one or more tubular members of each of the first and second circumferential sides of the inlet portion are symmetric about an axis bifurcating the respective first and second circumferential sides of the outlet and inlet portions.

According to yet another aspect of the disclosure, a heat exchanger assembly is provided and includes a backplane, an inlet manifold configured to direct fluid from a first backplane side to a second backplane side, first heat exchangers supported on the second backplane side and configured to direct the fluid in opposite outward directions, second heat exchangers and an outlet manifold. The second heat exchangers are supported on the first backplane side, include a linear array of tube joints and are configured to direct the fluid in opposite inward directions toward the tube joints. The outlet manifold includes, at opposite sides thereof, a linear array of tubular members configured to respectively connect with corresponding ones of each of the tube joints of each of the second heat exchangers.

These and other advantages and features will become more apparent from the following description taken in conjunction with the drawings.

BRIEF DESCRIPTION OF THE DRAWINGS

The subject matter, which is regarded as the disclosure, is particularly pointed out and distinctly claimed in the claims at the conclusion of the specification. The foregoing and other features and advantages of the disclosure are apparent from the following detailed description taken in conjunction with the accompanying drawings in which:

These and other advantages and features will become more apparent from the following description taken in conjunction with the drawings.

DETAILED DESCRIPTION

Some current heat exchanger assemblies require a component that will direct bleed air from heat exchangers to engine external ducting efficiently and with minimal disruptions. Thus, as will be described below, an outlet manifold is provided with a chamber that accepts discharged air from two heat exchanger cores and guides that discharged air to engine discharge ducting. More particularly, the outlet manifold can serve as an interface between stream heat exchangers and the engine ducting via tube seals and allows for excessive axial, lateral and radial tolerances during installation. The outlet manifold includes internal surfaces and curvatures that efficiently accept inlet air flows from up to six or more equal flow paths and minimizes air flow pressure drops. The outlet manifold is designed to work with various operating pressures, temperatures and ducting to enhance system performance in various applications.

Figure 1:
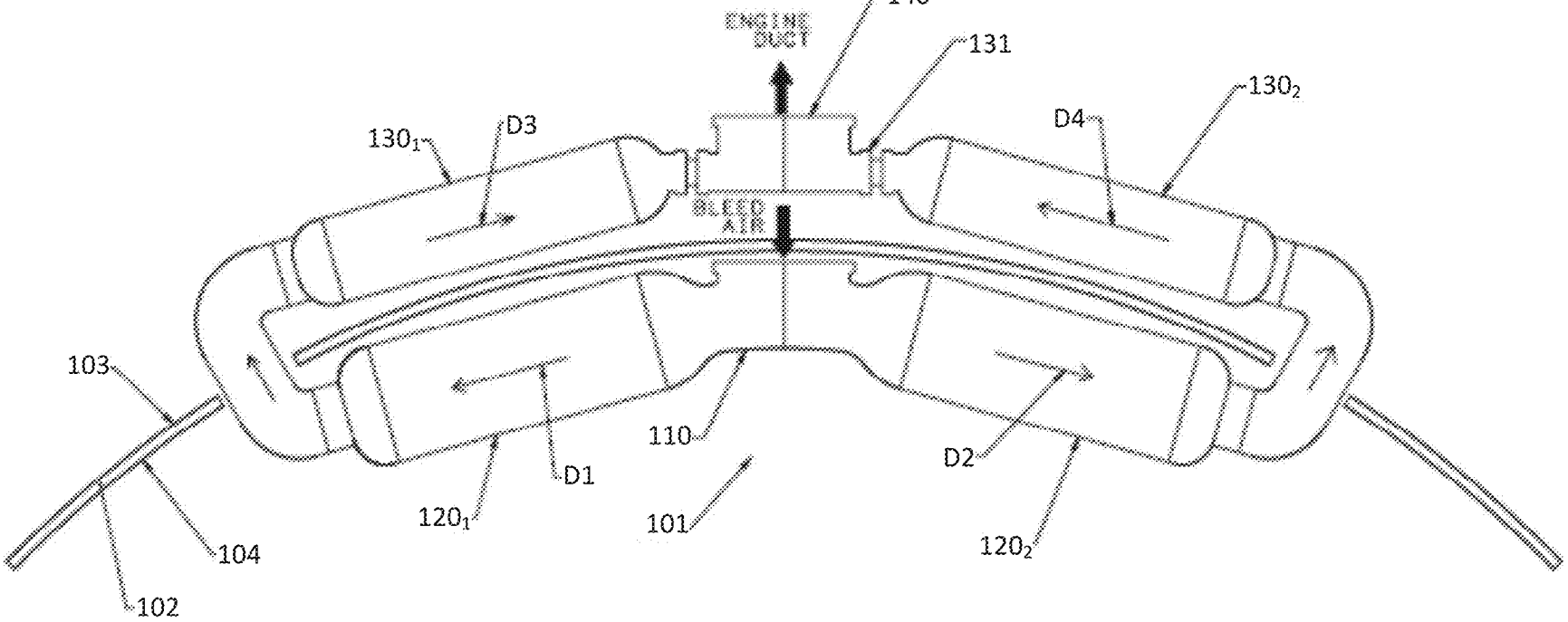
FIG. 1 is an axial view of a heat exchanger assembly in accordance with embodiments.

With reference to FIG. 1, a heat exchanger assembly 101 is provided. The heat exchanger assembly 101 includes a curved backplane 102 with a first backplane side 103 that faces radially outwardly and a second backplane side 104 opposite the first backplane side 103 that faces radially inwardly. The heat exchanger 101 further includes an inlet manifold 110 and respective sets of first and second heat exchangers 120 and 130. The inlet manifold 110 is receptive of fluid (e.g., bleed air) at the first backplane side 103 and is configured to direct the fluid from the first backplane side 103 to the second backplane side 104. The first heat exchangers $\mathbf{120}_1$ and $\mathbf{120}_2$ are supported on the second backplane side 104 at opposite circumferential sides of the inlet manifold 110 and are configured to direct the fluid in opposite circumferentially oriented outward directions D1 and D2. The second heat exchangers $\mathbf{130}_1$ and $\mathbf{130}_2$ are supported on the first backplane side 103 at the opposite circumferential sides of the inlet manifold 110. The second heat exchangers $\mathbf{130}_1$ and $\mathbf{130}_2$ each include one or more tube joints 131 and are configured to direct the fluid in opposite circumferentially oriented inward directions D3 and D4 toward the tube joints 131.

As shown in FIG. 1, the second heat exchanger $\mathbf{130}_1$ is receptive of fluid from the first heat exchanger $\mathbf{120}_1$ and the second heat exchanger $\mathbf{130}_2$ is receptive of fluid from the first heat exchanger $\mathbf{120}_2$. Thus, inward direction D3 is substantially opposed to outward direction D1 and inward direction D4 is substantially opposed to outward direction D2.

In addition, it is to be understood that the numbers of the one or more tube joints 131 for each of the second heat exchangers $\mathbf{130}_1$ and $\mathbf{130}_2$ are variable and need not be the same. However, for the purposes of clarity and brevity and unless otherwise stipulated, the following description will generally relate to the case that is illustrated in FIG. 1. That is, that the one or more tube joints 131 are provided as a set of three linearly arrayed tube joints 131 for the second heat exchanger $\mathbf{130}_1$ and as a set of three linearly arrayed tube joints 131 for the second heat exchanger $\mathbf{130}_2$.

Figure 2:
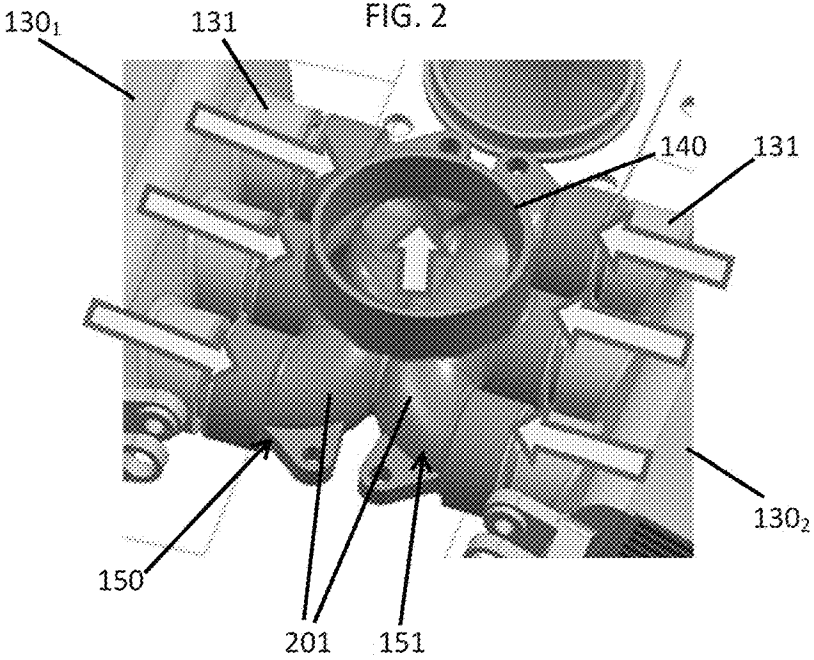
FIG. 2 is an enlarged view of an outlet manifold of the heat exchanger assembly of FIG. 1 in accordance with embodiments.
Figure 3:
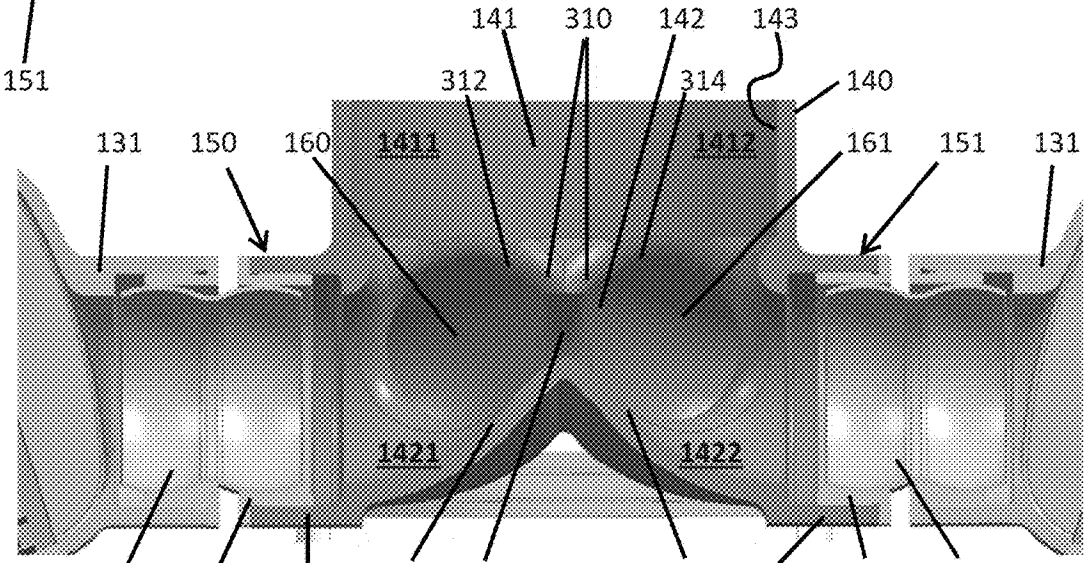
FIG. 3 is an enlarged side view of the outlet manifold of FIG. 2 in accordance with embodiments.

With continued reference to FIG. 1 and with additional reference to FIGS. 2 and 3, the heat exchanger assembly 101 further includes an outlet manifold 140. The outlet manifold 140 is coupled to engine ducting and includes, at opposite sides thereof, first and second linear arrays of three tubular members 150 and 151. Each of the three tubular members 150 of the first linear array is configured to respectively connect with a corresponding one of each of the three tube joints 131 of the second heat exchanger $\mathbf{130}_1$. Similarly, each of the three tubular members 151 of the second linear array is configured to respectively connect with a corresponding one of each of the three tube joints 131 of the second heat exchanger $\mathbf{130}_2$.

As shown in FIGS. 2 and 3, the outlet manifold 140 includes an outlet portion 141 and an inlet portion 142. The outlet portion 141 has an annular shape and is formed to define opposed first and second circumferential sides 1411 and 1412. The outlet portion 141 can include a connection mechanism 1413, such as internal threading or other features, for connection to the engine duct. The outlet portion 141 is fluidly coupled to the inlet portion 142.

The inlet portion 142 has first and second circumferential sides 1421 and 1422 that correspond to the first and second circumferential sides 1411 and 1412 of the outlet portion 141. The first circumferential side 1421 of the inlet portion 142 includes the three tubular members 150 of the first linear array and a mixing chamber 160. The mixing chamber 160 is generally disposed adjacent to the first circumferential side 1411 of the outlet portion 141. The mixing chamber 160 is thus fluidly interposed between each of the three tubular members 150 and at least the first circumferential side 1411 of the outlet portion 141. The tubular members 150 extend laterally or circumferentially outwardly from the mixing chamber 160. The second circumferential side 1422 of the inlet portion 142 includes the three tubular members 151 of the second linear array and a mixing chamber 161. The mixing chamber 161 is generally disposed adjacent to the second circumferential side 1411 of the outlet portion 141. The mixing chamber 161 is thus fluidly interposed between each of the three tubular members 151 and at least the second circumferential side 1412 of the outlet portion 141. The tubular members 151 extend laterally or circumferentially outwardly from the mixing chamber 161.

As shown in FIG. 3, each tubular member 150 and each tubular member 151 includes a tubular member end 301, a bushing 302, which is fittable onto the tubular member end 301 (a similar bushing is fittable onto the tube joint 131), and a tube seal 303, which is fittable in an interior of the bushing 302. In accordance with embodiments, the bushings 302 can be press-fit bushings and provide for close tolerance sealing for the tube seals 303 under most or all tolerance conditions.

In addition, as shown in FIG. 3, the mixing chambers 160 and 161 of the first and second circumferential sides 1421 and 1422 of the inlet portion 142 may include curved surfaces 310 leading to the outlet portion 141. The curved surfaces 310 serve to minimize a pressure drop of fluid moving through the outlet manifold 140 from the tube joints 131 to the engine duct. In particular, the curved surfaces 310 include a curved lower surface 311 and a curved upper surface 312 in the mixing chamber 160 and a curved lower surface 313 and a curved upper surface 314 in the mixing chamber 161. In profile, the curved lower surface 311 and the curved upper surface 312 define an annular region within the mixing chamber 160 that is fluidly communicative with the tubular members 150 and the outlet portion 141 and the curved lower surface 313 and the curved upper surface 314 define an annular region within the mixing chamber 161 that is fluidly communicative with the tubular members 151 and the outlet portion 141. In addition, the curved lower surfaces 311 and 313 form a tip opposite a tip formed by the curved upper surfaces 312 and 314. The tips are displaced from one another to define an aperture 315 through which the mixing chambers 160 and 161 are fluidly communicative.

Figure 5:
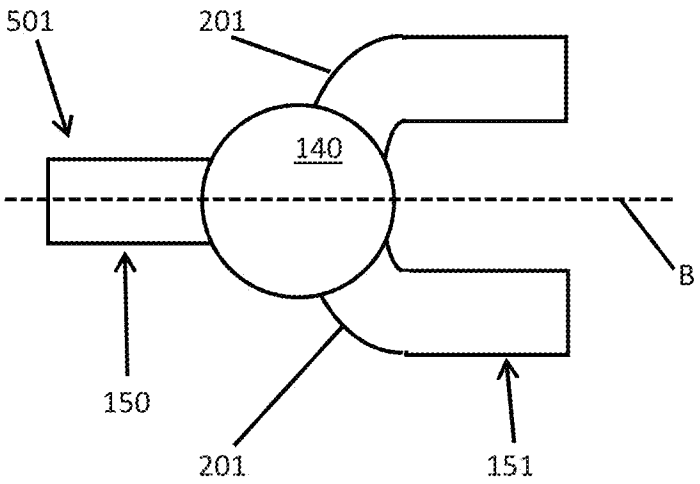
FIG. 5 is a top down schematic view of the outlet manifold of FIGS. 2 and 3 in accordance with alternative embodiments.
Figure 4:
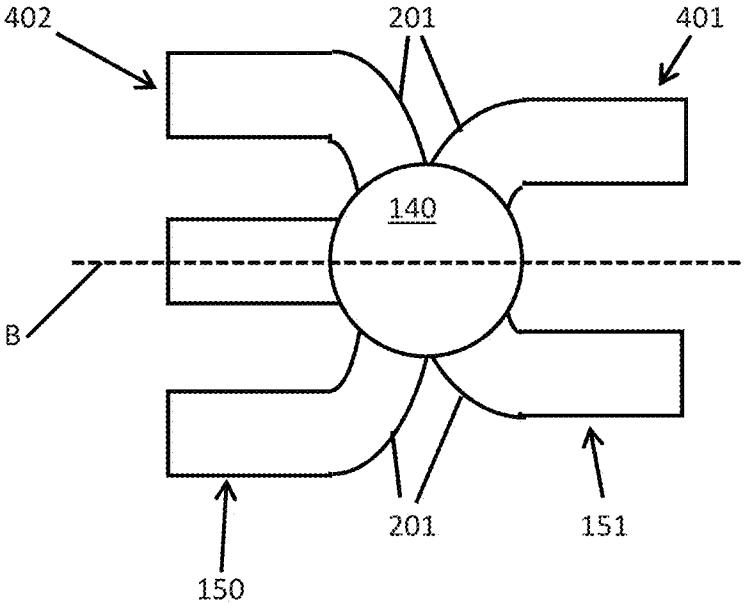
FIG. 4 is a top down schematic view of the outlet manifold of FIGS. 2 and 3 in accordance with alternative embodiments.

With continued reference to FIG. 2 and with additional reference to FIGS. 4 and 5, the tubular members 150 and 151 are symmetric about an axis B bifurcating the first and second circumferential sides 1411 and 1412 of the outlet portion 141 and the first and second circumferential sides 1421 and 1422 of the inlet portion 142. This is the case even where the tubular members 150 or 151 are provided as one tubular member 501, two tubular members 401 or three or more tubular members 402. In any case, in accordance with embodiments, for each tubular member 150 or 151 for which the tubular member end 301 (see FIG. 3) is offset (e.g., from a center of the mixing chambers 160 and 161 as in the case of two, three or more tubular members 150 or 151), the tubular member 150 or 151 includes a curved section 201 that curves inwardly toward the corresponding mixing chamber 160 or 161.

Technical effects and benefits of the present disclosure are the provision of an outlet manifold that is small enough to fit within restrictive spatial envelopes and can withstand high temperatures and pressures without creating substantial pressure drops.

While the disclosure is provided in detail in connection with only a limited number of embodiments, it should be readily understood that the disclosure is not limited to such disclosed embodiments. Rather, the disclosure can be modified to incorporate any number of variations, alterations, substitutions or equivalent arrangements not heretofore described, but which are commensurate with the spirit and scope of the disclosure. Additionally, while various embodiments of the disclosure have been described, it is to be understood that the exemplary embodiment(s) may include only some of the described exemplary aspects. Accordingly, the disclosure is not to be seen as limited by the foregoing description, but is only limited by the scope of the appended claims.

What is claimed is:

1. An outlet manifold, comprising:

an outlet portion having an outlet axis and first and second sides on either side of the outlet axis; and an inlet portion to which the outlet portion is fluidly coupled, the inlet portion having first and second sides corresponding to the first and second sides of the outlet portion, the first side of the inlet portion comprising one or more first tubular members having respective first axes oriented transversely with respect to the outlet axis and being connectable with corresponding first tube joints such that first fluid flows flow through the corresponding first tube joints and the one or more first tubular members in a first direction, and the second side of the inlet portion comprising one or more second tubular members having respective second axes oriented transversely with respect to the outlet axis and being connectable with corresponding second tube joints such that second fluid flows flow through the corresponding second tube joints and the one or more second tubular members in a second direction opposite the first direction; and a mixing chamber fluidly interposed between each of the one or more first and second tubular members and the outlet portion such that the first and second fluid flows in the first and second directions, respectively, are redirected through the outlet portion and along the outlet axis.

2. The outlet manifold according to claim 1, wherein the outlet portion has an annular shape defining the first and second sides.

3. The outlet manifold according to claim 1, wherein:

the mixing chambers are adjacent to the outlet portion, and the one or more tubular members of each of the first and second sides of the inlet portion extend laterally outwardly from the respective mixing chambers.

4. The outlet manifold according to claim 1, wherein each tubular member comprises:

a tubular member end;

a bushing, which is fittable onto the tubular member end; and a tube seal, which is fittable in an interior of the bushing.

5. The outlet manifold according to claim 4, wherein, for each tubular member for which the tubular member end is offset from a center of the mixing chamber, the tubular member comprises a curved section.

6. The outlet manifold according to claim 1, wherein the mixing chambers of the first and second sides of the inlet portion comprise curved surfaces leading to the outlet portion.

7. The outlet manifold according to claim 1, wherein the mixing chambers of the first and second sides of the inlet portion are fluidly communicative through a common orifice.

8. The outlet manifold according to claim 1, wherein the one or more tubular members of each of the first and second sides of the inlet portion are symmetric about an axis bifurcating the respective first and second sides of the outlet and inlet portions.

9. An outlet manifold, comprising:

an outlet portion having an outlet axis and first and second sides on either side of the outlet axis; and an inlet portion to which the outlet portion is fluidly coupled and having first and second sides corresponding to the first and second sides of the outlet portion, the first side comprising first tubular members having first axes transverse to the outlet axis and being connectable with first tube joints such that first fluid flows flow through the first tube joints and the first tubular members in a first direction and the second side comprising second tubular members having second axes transverse to the outlet axis and being connectable with second tube joints such that second fluid flows flow through the second tube joints and the second tubular members in a second direction opposite the first direction; and a mixing chamber fluidly interposed between each of the first and second tubular members and the outlet portion such that the first and second fluid flows in the first and second directions are redirected through the outlet portion and along the outlet axis.

* * * * *